US006744028B2

(12) United States Patent
Chisholm et al.

(10) Patent No.: US 6,744,028 B2
(45) Date of Patent: Jun. 1, 2004

(54) SEMI-RIGID HAND-HELD FOOD PACKAGE

(75) Inventors: Gary Chisholm, Vernon, CA (US); Shana Whitmore, Manhattan Beach, CA (US)

(73) Assignee: Mars Incorporated, Mclean, VA (US)

( * ) Notice: Subject to any disclaimer, the term of this patent is extended or adjusted under 35 U.S.C. 154(b) by 0 days.

(21) Appl. No.: 10/189,137

(22) Filed: Jul. 3, 2002

(65) Prior Publication Data

US 2003/0080119 A1 May 1, 2003

Related U.S. Application Data

(63) Continuation-in-part of application No. 10/037,424, filed on Oct. 29, 2001, now Pat. No. 6,710,315.

(51) Int. Cl.[7] ..... H05B 6/80

(52) U.S. Cl. ..... 219/730; 219/732; 426/112

(58) Field of Search ..... 219/730, 732, 219/735, 759, 725, 727, 728, 729, 686; 426/118, 112, 234, 107, 241, 243, 109, 113; 383/100, 103, 204; 428/35.8; 229/123.2, 125.35, 238, 903; 99/DIG. 14

(56) References Cited

U.S. PATENT DOCUMENTS

| | | | | |
|---|---|---|---|---|
| 2,617,549 | A | | 11/1952 | Egger |
| 3,785,254 | A | | 1/1974 | Mann |
| 3,908,523 | A | | 9/1975 | Shikaya |
| 3,961,569 | A | | 6/1976 | Kenyon et al. |
| 4,080,880 | A | | 3/1978 | Shikaya |
| 4,155,895 | A | | 5/1979 | Rohowetz et al. |
| 4,435,344 | A | | 3/1984 | Iioka |
| 4,641,005 | A | | 2/1987 | Seiferth |
| 4,775,771 | A | | 10/1988 | Pawlowski et al. |
| 4,780,587 | A | | 10/1988 | Brown |
| 4,825,025 | A | | 4/1989 | Seiferth |
| 4,848,649 | A | | 7/1989 | Fuller et al. |
| 4,948,932 | A | | 8/1990 | Clough |
| 5,009,326 | A | | 4/1991 | Reaves et al. |
| 5,038,009 | A | | 8/1991 | Babbitt |
| 5,092,485 | A | | 3/1992 | Lee |
| 5,097,107 | A | * | 3/1992 | Watkins et al. ..... 219/727 |
| 5,114,068 | A | | 5/1992 | Reil et al. |
| 5,144,106 | A | * | 9/1992 | Kearns et al. ..... 219/731 |
| 5,205,473 | A | | 4/1993 | Coffin, Sr. |
| 5,215,249 | A | | 6/1993 | Gorrieri |
| 5,217,768 | A | * | 6/1993 | Walters et al. ..... 428/35.8 |
| 5,241,150 | A | | 8/1993 | Garvey et al. |
| 5,254,821 | A | | 10/1993 | Walters |
| 5,300,746 | A | | 4/1994 | Walters et al. |
| 5,411,202 | A | | 5/1995 | Fenini |
| 5,464,969 | A | | 11/1995 | Miller |
| 5,530,231 | A | | 6/1996 | Walters et al. |
| 5,698,127 | A | | 12/1997 | Lai et al. |
| 5,772,111 | A | | 6/1998 | Kirsch |
| 5,826,786 | A | | 10/1998 | Dickert |
| 5,830,548 | A | | 11/1998 | Andersen et al. |
| 5,839,653 | A | | 11/1998 | Zadravetz |
| 6,054,698 | A | | 4/2000 | Mast |
| 6,102,281 | A | | 8/2000 | Lafferty et al. |
| 6,114,679 | A | | 9/2000 | Lai et al. |
| 6,133,560 | A | | 10/2000 | Zeng et al. |
| 6,150,646 | A | | 11/2000 | Lai et al. |
| 6,196,408 | B1 | | 3/2001 | Setty et al. |
| 6,251,451 | B1 | | 6/2001 | Zeng |
| 6,259,079 | B1 | | 7/2001 | Ji et al. |
| 6,261,611 | B1 | | 7/2001 | Berman |
| 6,386,438 | B1 | | 5/2002 | Walsh et al. |
| 2002/0037344 | A1 | | 3/2002 | Gibernau |

FOREIGN PATENT DOCUMENTS

| | | |
|---|---|---|
| EP | 1190960 A2 | 3/2002 |
| GB | 2352706 A | 2/2001 |
| JP | 2001353069 | 12/2001 |

* cited by examiner

*Primary Examiner*—Quang T. Van
(74) *Attorney, Agent, or Firm*—Fulbright & Jaworski, L.L.P.

(57) ABSTRACT

The present invention is directed to a convenient semi-rigid hand-held microwaveable package. The package contains a thermal insulating layer that protects the consumer from being burned by handling the hot package. Yet further, the package also contains an easy open device.

16 Claims, 20 Drawing Sheets

SEMI-RIGID HAND-HELD FOOD PACKAGE

This is a continuation-in-part of U.S. application Ser. No. 10/037,424, which was filed on Oct. 29, 2001 now U.S. Pat. No. 6,710,315.

FIELD OF THE INVENTION

The present invention relates to a semi-rigid, hand-held package for use as a convenient microwaveable food container. More particularly, the package includes a thermal insulating surface to protect the consumer from the hot item. Another aspect of the hand-held package is an easy open tear strip device.

BACKGROUND OF THE INVENTION

The use of microwave energy for cooking has been available for many years. Microwave shielding material is known in the art to shield microwave energy from a food product or to focus microwave energy to a particular portion of a food product in order to cook the food. Microwave susceptor materials are known in the art and are used in microwave cooking apparatuses for directly heating food and for browning by conduction from the microwave susceptor material heated by the absorption of microwaves.

Numerous microwaveable products are on the market that consists of food items such as burritos, croissant pockets, sandwiches and pizzas, packaged in various kinds of cartons, and trays. The food items of these products are typically removed from an outer carton or wrapper and placed in a microwave oven for cooking. A susceptor material may or may not surround the food item while cooking. At the completion of cooking, the food items are removed from the microwave oven and have a required sit time, before the product can be handled for eating.

The self-venting microwaveable package disclosed in U.S. Pat. No. 5,464,969 is a microwaveable plastic bag for heating a variety of products including liquids. One seam of the bag incorporates a strip seal that vents when enough pressure is generated in the bag in order to prevent explosion of the bag.

A multi-layer microwave conductive structure is disclosed in U.S. Pat. No. 5,530,231, which is incorporated herein by reference. The disclosed conductive structure for use in microwave food packaging adapts itself to heat food articles in a safer, more uniform manner. The structure includes a conductive layer disposed on a non-conductive substrate. An aspect of the structure's conductive layer of links and base areas causes microwave induced current to be channeled through the links resulting in controlled heating.

Metallized microwave diffuser films are disclosed in U.S. Pat. No. 5,300,746, which is incorporated herein by reference. The films include an insulative substrate, having a first side upon which is deposited a metallic coating capable of selectively reflecting a portion of incoming microwave energy.

Susceptor sleeves for browning or crisping food in microwave ovens are known in the art as described in U.S. Pat. Nos. 4,948,932 and 4,775,771. These patents describe sleeves formed from flexible or semi-flexible substrates that include a susceptor material. A food item is placed within the sleeve and then cooked in microwave oven. Sleeves for insulating containers containing hot liquids are described in U.S. Pat. No. 5,205,473 which discloses an insulating beverage container holder formed of a tubular sleeve made from corrugated cellulose material. However, the sleeves of the U.S. Pat. No. 5,205,473 patent are not designed for insulating a container containing a food item that is being cooking in a microwave oven.

Those systems, which disclose containers for heating or cooking using microwave energy or disclose materials which reflect microwave energy or become hot upon contact with microwave energy transmission, may be used to heat and cook food products adequately, however, the containers that contain the food become extremely hot. In this respect, the present microwaveable packages are time consuming and inefficient because time is lost in waiting for the container to cool before it can be handled and/or the food has to be transferred to another receptacle that can be held. The microwaveable packages are not designed for handling while eating the cooked food at its optimal temperature because at the optimal eating temperature the package is too hot to hold. Further, current microwaveable packages are not configured to fit in one hand of the user while being eaten.

Therefore, there is a need in the art for a microwave heating package system which may be used to heat a fresh, frozen or refrigerated, cooked or uncooked food item, or any other item in a microwave oven that is a hand held microwave appropriate container designed for single handed use and portability. There is also a need in the art for a hand held container that is configured to provide the user with a cool surface for holding the container and using the contents of the container, while keeping the contents of the container hot. Thus, the present invention allows for immediate handling of the container and eliminates the need for additional receptacles to hold the hot item.

BRIEF SUMMARY OF THE INVENTION

The present invention is directed to a hand-held package for use as a convenient microwaveable container. Specifically, the container comprises an easy open device, and is insulated to protect the consumer from the hot item. More particularly, the container includes a semi-rigid outer component, a semi-rigid inner component and a thermal insulating surface. The semi-rigid inner component may have a microwave susceptor surface positioned as an inner surface of the inner component.

Another embodiment of the present invention is a container for heating an item using microwaves that includes a container having a semi-rigid outer component and a semi-rigid inner component; a thermal insulating layer, which protects the consumer from being burned from the hot item after heating in a microwave oven; and an easy open device. The easy open device allows for easy and convenient access to the item after heating in a microwave oven. Also, the semi-rigid inner component may have a microwave susceptor surface positioned as an inner surface of the inner component.

The foregoing has outlined rather broadly the features and technical advantages of the present invention in order that the following detailed description of the invention may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only, and is not intended as a definition of the limits of the present invention.

BRIEF DESCRIPTION OF THE DRAWINGS

For a more complete understanding of the present invention, reference is now made to the following descriptions taken in conjunction with the accompanying drawings.

DETAILED DESCRIPTION OF THE INVENTION

Figure 1A:
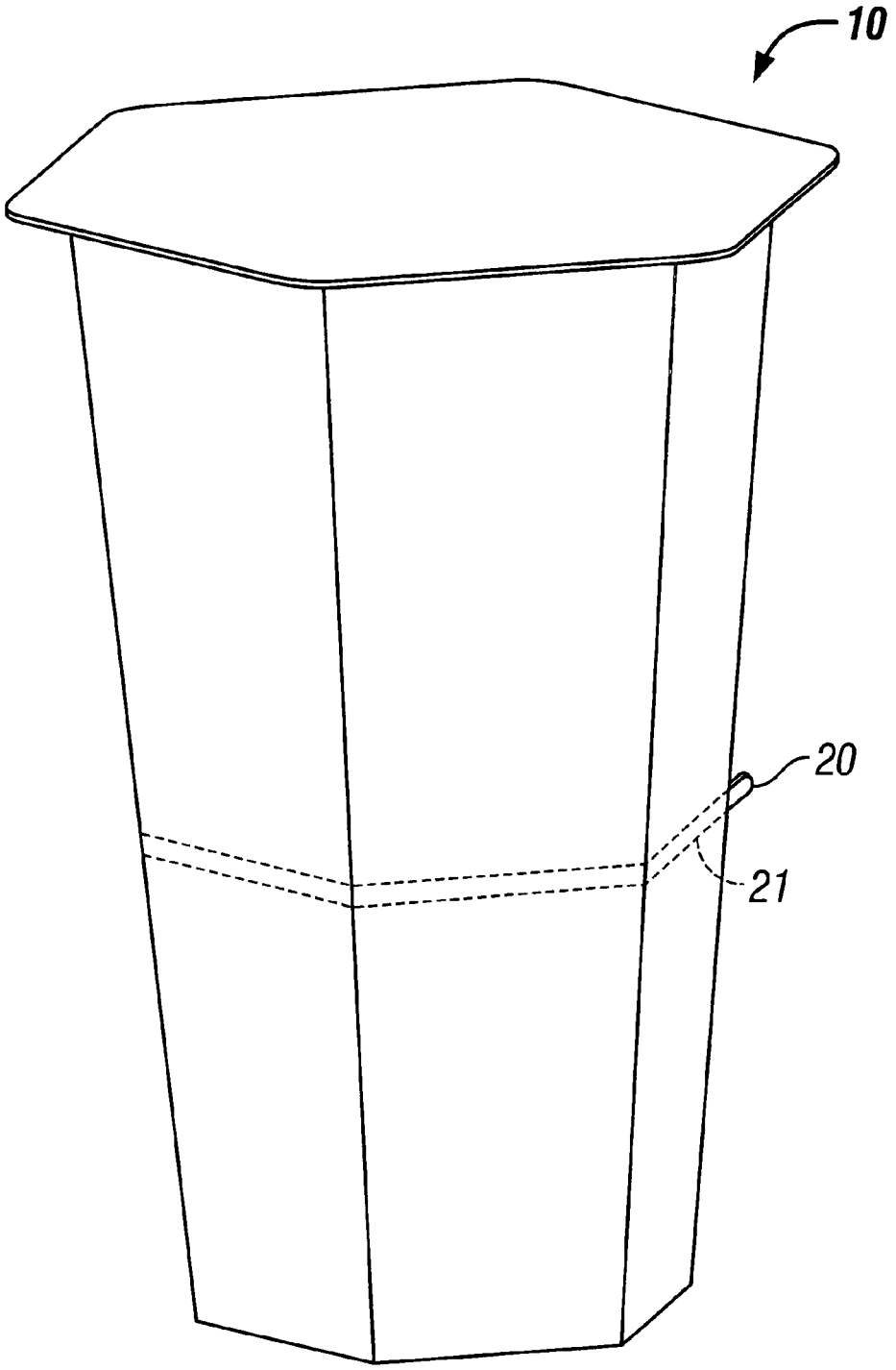
FIG. 1A and FIG. 1B illustrate a container comprising the tear-strip in alternative locations of the present invention.

It is readily apparent to one skilled in the art that various embodiments and modifications can be made to the invention disclosed in this Application without departing from the scope and spirit of the invention.

As used herein, the use of the word "a" or "an" when used in conjunction with the term "comprising" in the sentences and/or the specification can mean "one," but it is also consistent with the meaning of "one or more," "at least one," and "one or more than one."

The present invention is directed to a hand held microwave appropriate container that is designed for single handed use and portability. A microwave appropriate container is one that does not melt, spark or deform during microwave use. A microwave appropriate container also retains it structure during microwave heating or cooking. The hand held container allows for heating and cooking the contents in the container by way of microwave energy. The hand held container is configured to provide the user with a cool surface for holding the container when using or eating the contents of the container, while the contents of the container remain hot. In one configuration of the container a thermal insulating material can provide the enclosed structure for food or other items. In other embodiments, the thermal insulating material covers a portion or all of the surface of the container. In the present invention, the thermal insulating material is between the inner and outer component. This is an important aspect of the present invention because microwaveable packages and its contents can reach a temperature of up to 400° F. while in a microwave oven. The thermal insulating layer on the inventive container provides a cooler surface so that a user can hold the hand held microwave container immediately upon removal from a microwave oven. This is because the thermal insulating layer provides a lowered rate of heat transfer from inside the container to an outer surface of the container.

Referring now in more detail to the drawings, in which like numerals refer to like parts throughout several views, the container 10 for an item 30 includes an easy open device including a tear-strip 21 which is connected to a gripping tab 20. The container 10 can include one or more components, for example, an outer component 110 and an inner component 120. A third component, such as outer packaging material or an additional inner component is also contemplated. The item 30 may be any food that can be fresh, frozen, or chilled and thereafter microwaved for human consumption. It is also envisioned that the item 30 may be a pet food for consumption by a companion animal. In further embodiments, the item 30 may also include medical supplies, cosmetics, craft supplies or any other non-food item that requires heating.

The microwaveable container 10 can be formed from material that provides for a semi-rigid container. Semi-rigid material can include for example, paperboard, corrugated board (micro-flute, E, F or B shaped flute or any other fluted board), paperboard canister, plastic sheet, preferably polyethylene terephthalate (PET) or other high melt temperature resin. The paperboard could be laminated with a number of films such as susceptor film, PET, or polypropylene. Any form of polyester is also suitable as a semi-rigid or flexible material.

Figure 1B:
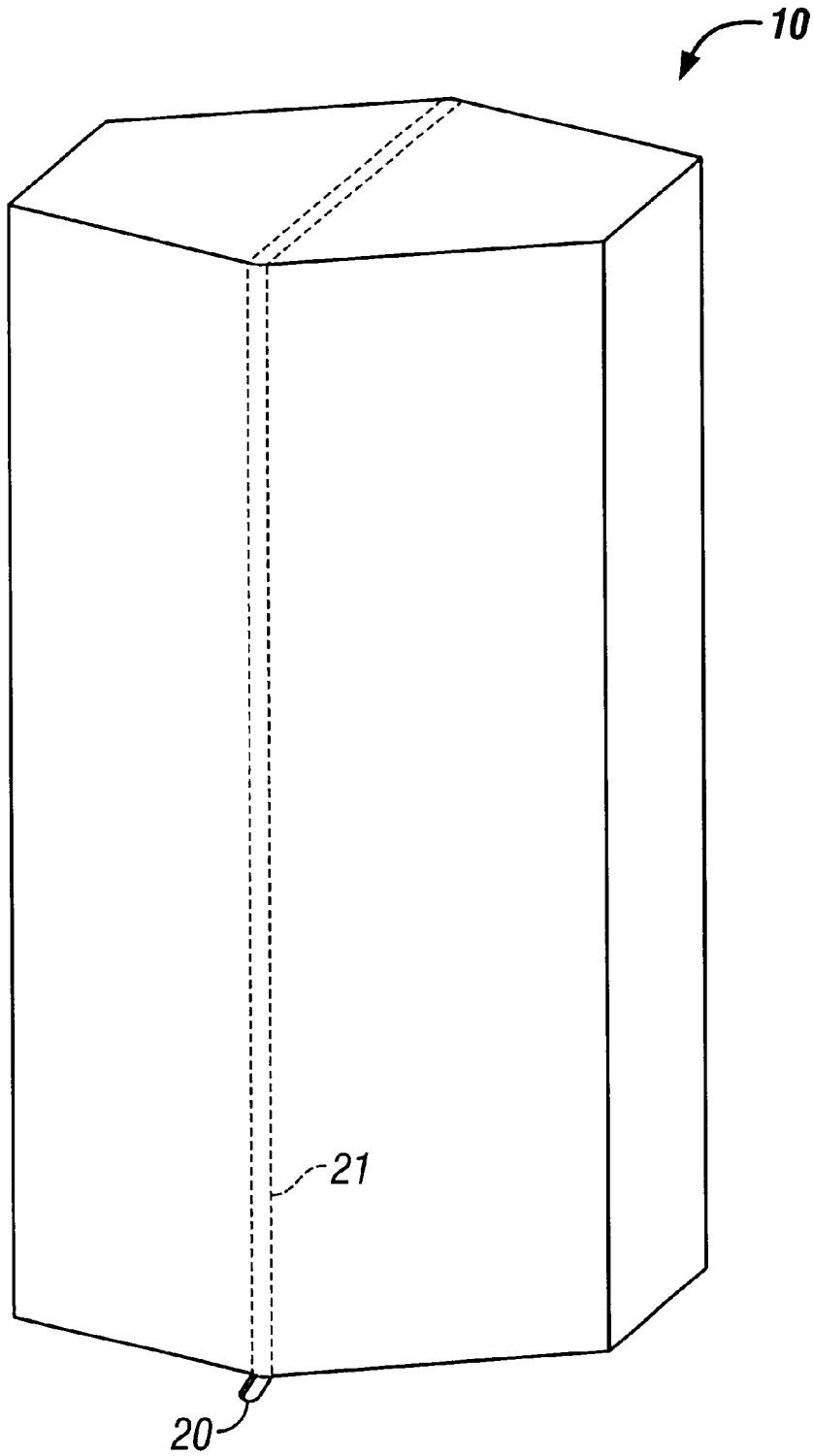
Figure 2A:
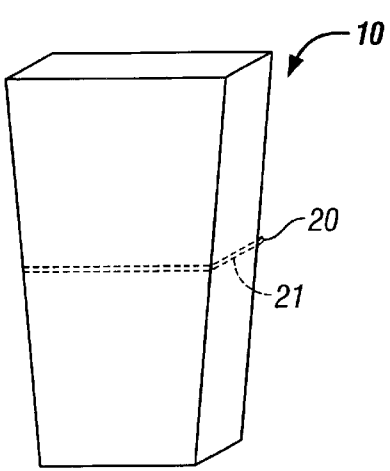
FIG. 2A, FIG. 2B, FIG. 2C, FIG. 2D, FIG. 2E and FIG. 2F illustrate a variety of possible shapes for the container of the present invention.
Figure 2B:
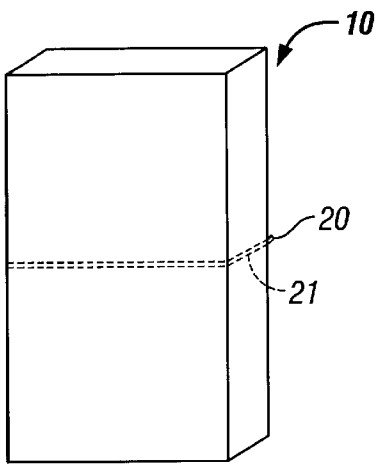
Figure 2C:
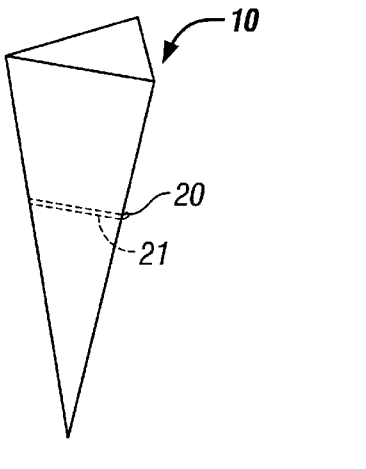
Figure 2D:
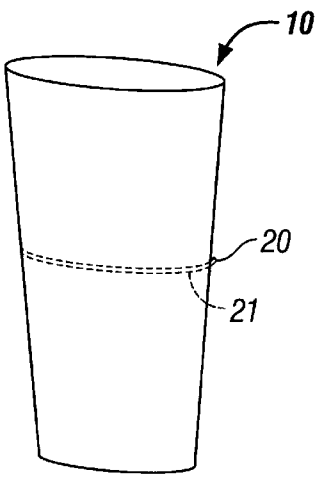
Figure 2E:
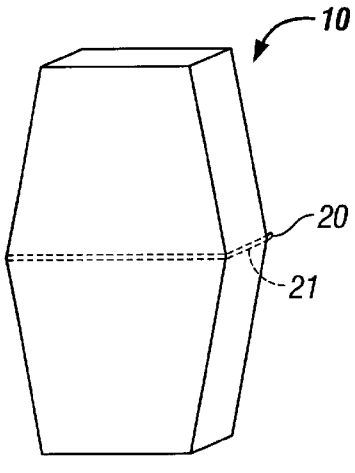
Figure 2F:
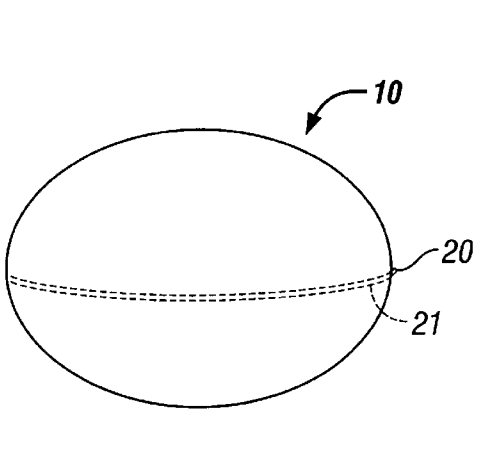

As shown in FIG. 1A and FIG. 1B the tear-strip 21 and gripper tab 20 can be positioned either horizontally (FIG. 1A) or vertically (FIG. 1B) around the container 10. The present invention is not limited to the easy open feature of the tear-strip 21 and gripper tab 20, it is understood that other kinds of easy open mechanisms can be used. The tear-strip 21 and gripper tab 20 or any other easy open mechanism can be positioned at any location on the container in order to open the container such that an adequately sized container is provided that will perform as a receptacle for any given item. It is also understood that the any easy open mechanism, including tear-strip 21, can wrap around the entire container or partially wrap around the container.

FIG. 2A–FIG. 2F illustrates various shapes of containers that are contemplated in the present invention. Exemplary shapes include, but are not limited to an octagon, a hexagon, a polyhedron, a cylinder, a prism, sphere, ellipsoid, circular or egg-shaped, or a variant thereof. As used herein, the term polyhedron refers to a solid object or a three-dimensional object bounded by polygons, which is a closed plane figure bounded by three or more line segments. A cylinder of the present invention refers to a solid bounded by two parallel planes with a surface having a circle as a directrix. Yet further, a prism of the present invention includes a solid figure whose bases or ends have the same size and shape, and are parallel to one another and each of whose sides is a parallelogram. A sphere of the present invention refers to a three-dimensional object that has all points equidistant from a fixed point. An ellipsoid of the present invention relates to an object having plane sections that are either ellipses or circles.

Figure 3A:
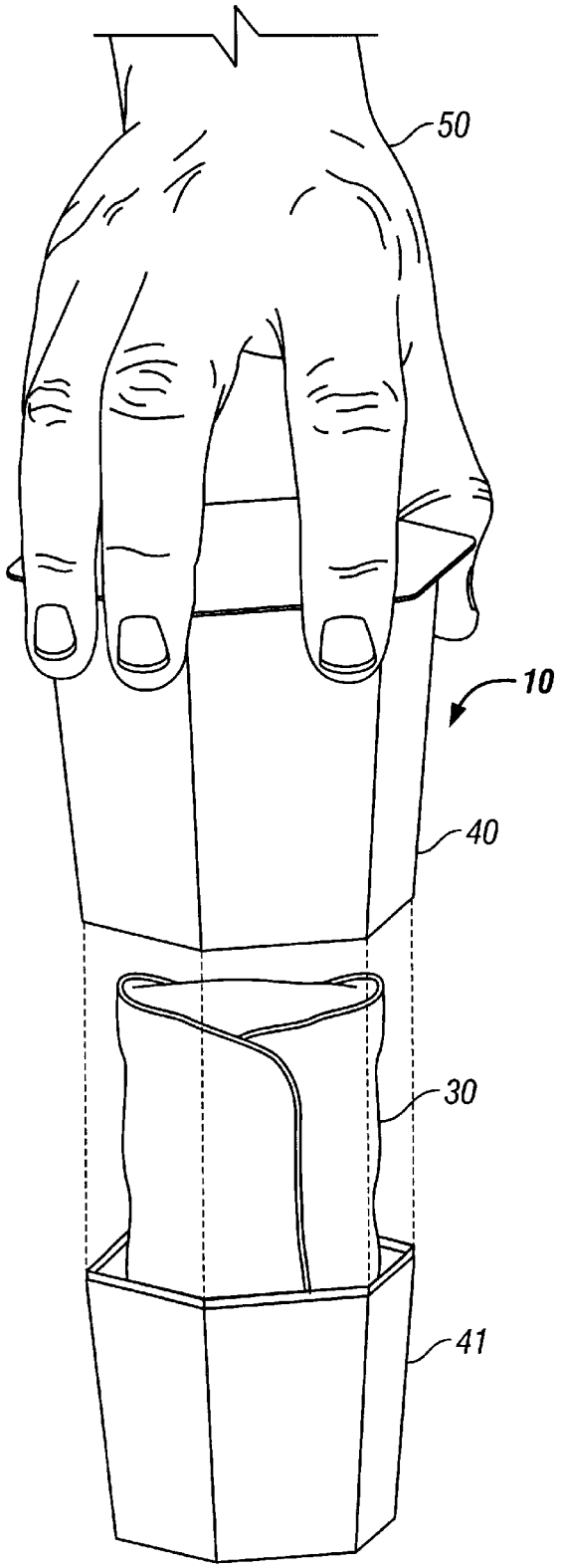
FIG. 3A and FIG. 3B illustrate the container in an open position in which the container is separated into two parts.
Figure 3B:
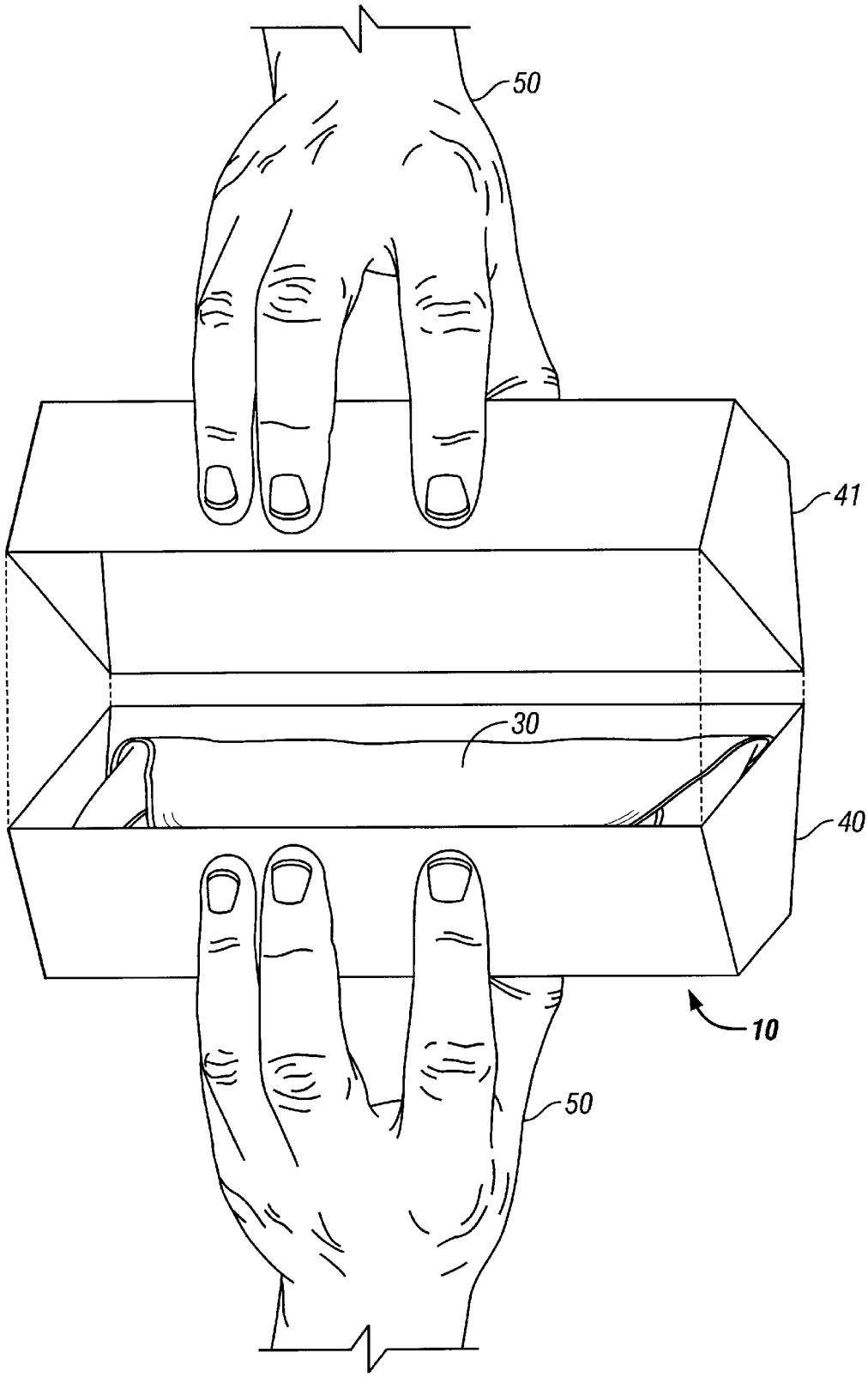
Figure 4:
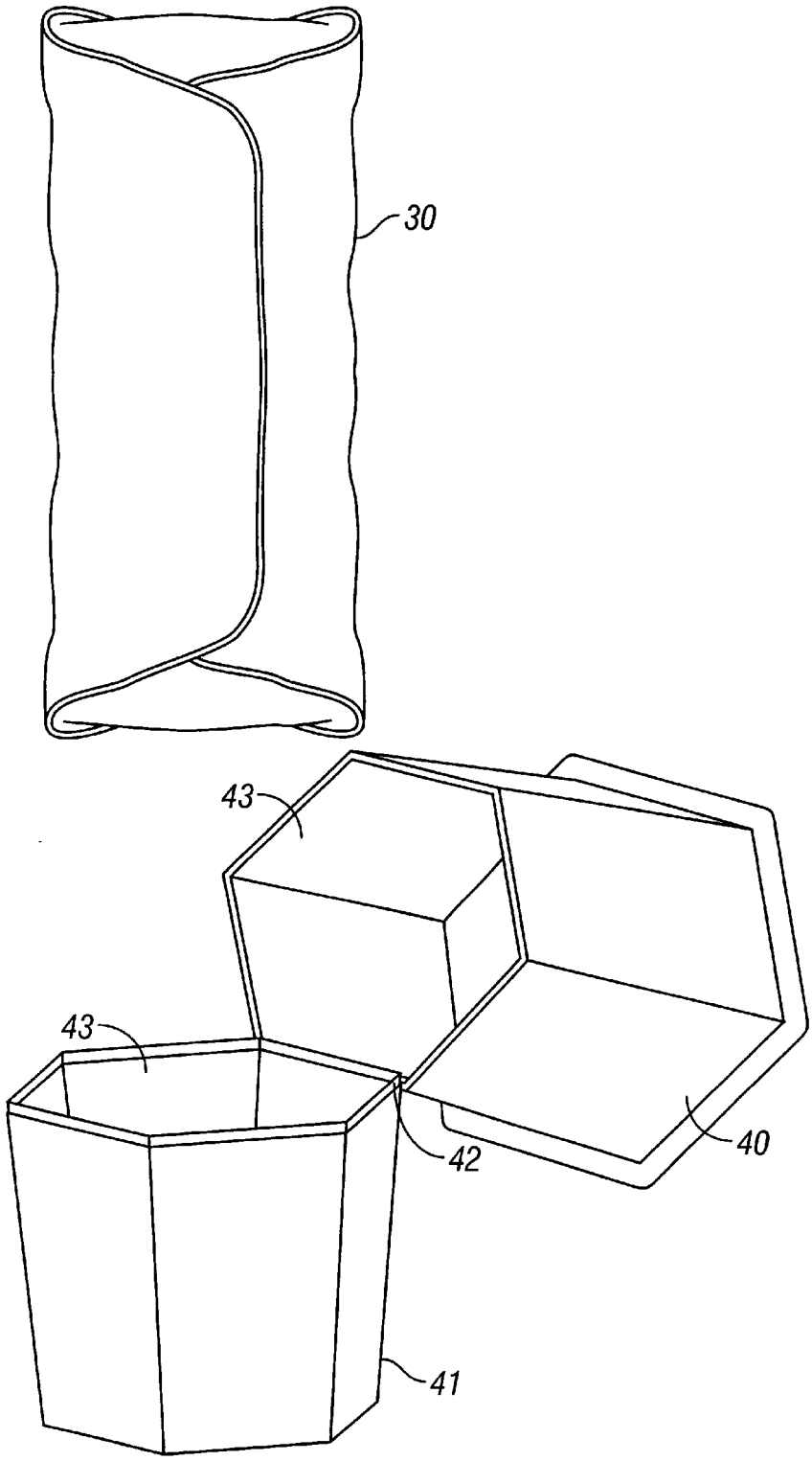
FIG. 4 illustrates the container in an open position in which the container is not separated into parts.

Referring to FIG. 3A, FIG. 3B and FIG. 4, the container, 10 containing a food item 30 of the present invention, can be separated into two parts 40, 41. The separation of the container 10 occurs via a tear-strip 21 of which is positioned horizontally or vertically on the container. The tearing action results in a separation of the container into two parts 40, 41. Complete separation is not essential. In fact, the container may only be partially separated having an opening 43 and a hinge 42 to allow the consumer to use both portions of the container 10 for receptacles of the item 30 or other items, such as condiments.

Figure 5A:
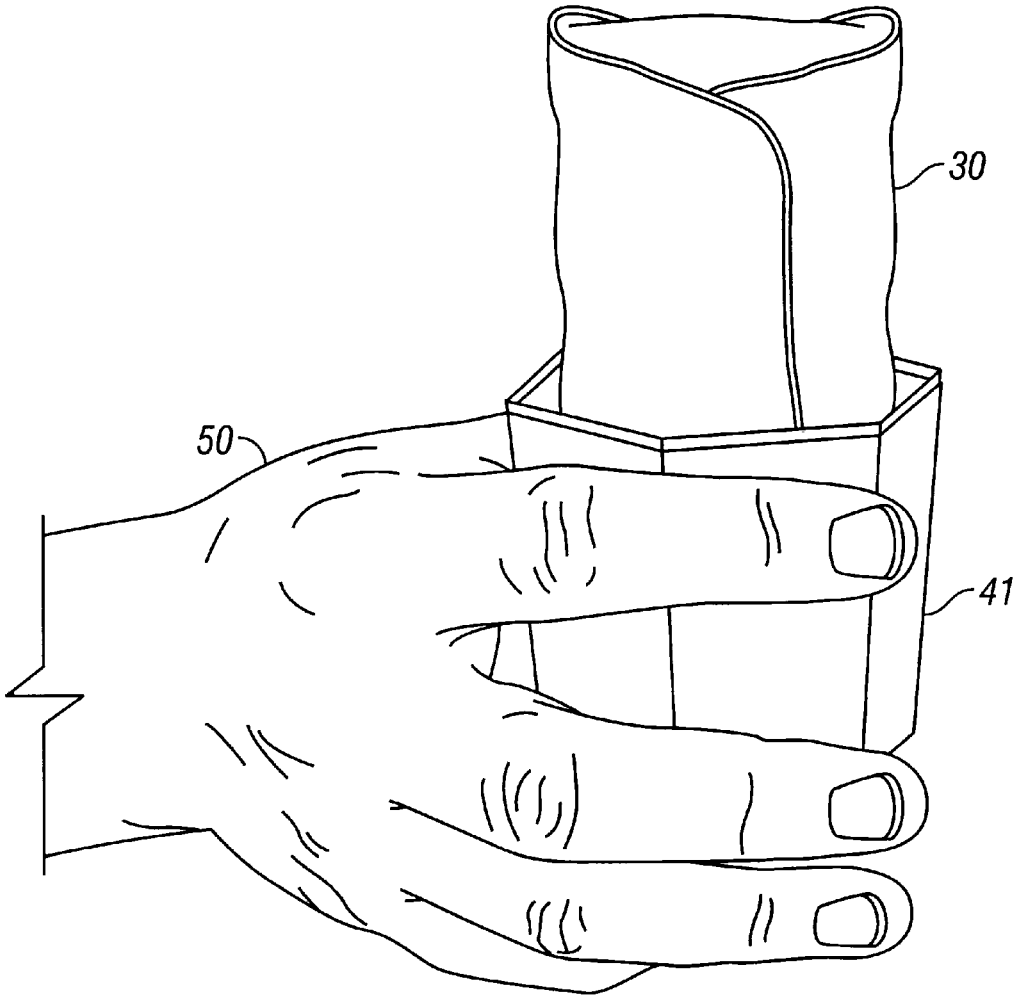
FIG. 5A and FIG. 5B illustrate that the container can be held by one hand for consumption.
Figure 5B:
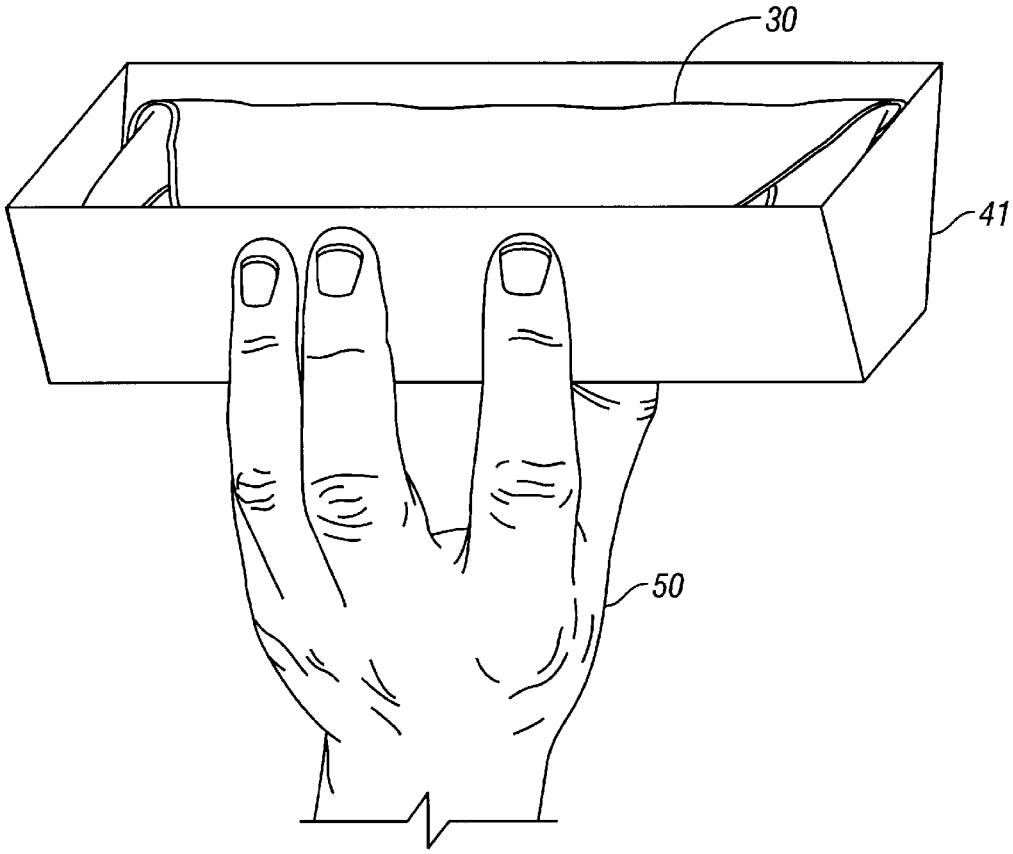

As shown in FIG. 5A and FIG. 5B, the present invention is designed to be held in one hand 50 while using the item. For example, the consumer microwaves the container having an item, tears open the container and removes the top part 40, and holds the bottom part 41 of the container to consume the hot item. The benefit of the present invention is that the consumer does not have to wait for the container to cool before it can be held. In fact, the container can be removed immediately from the microwave oven and held in one hand without burning the hand of the consumer.

Figure 6A:
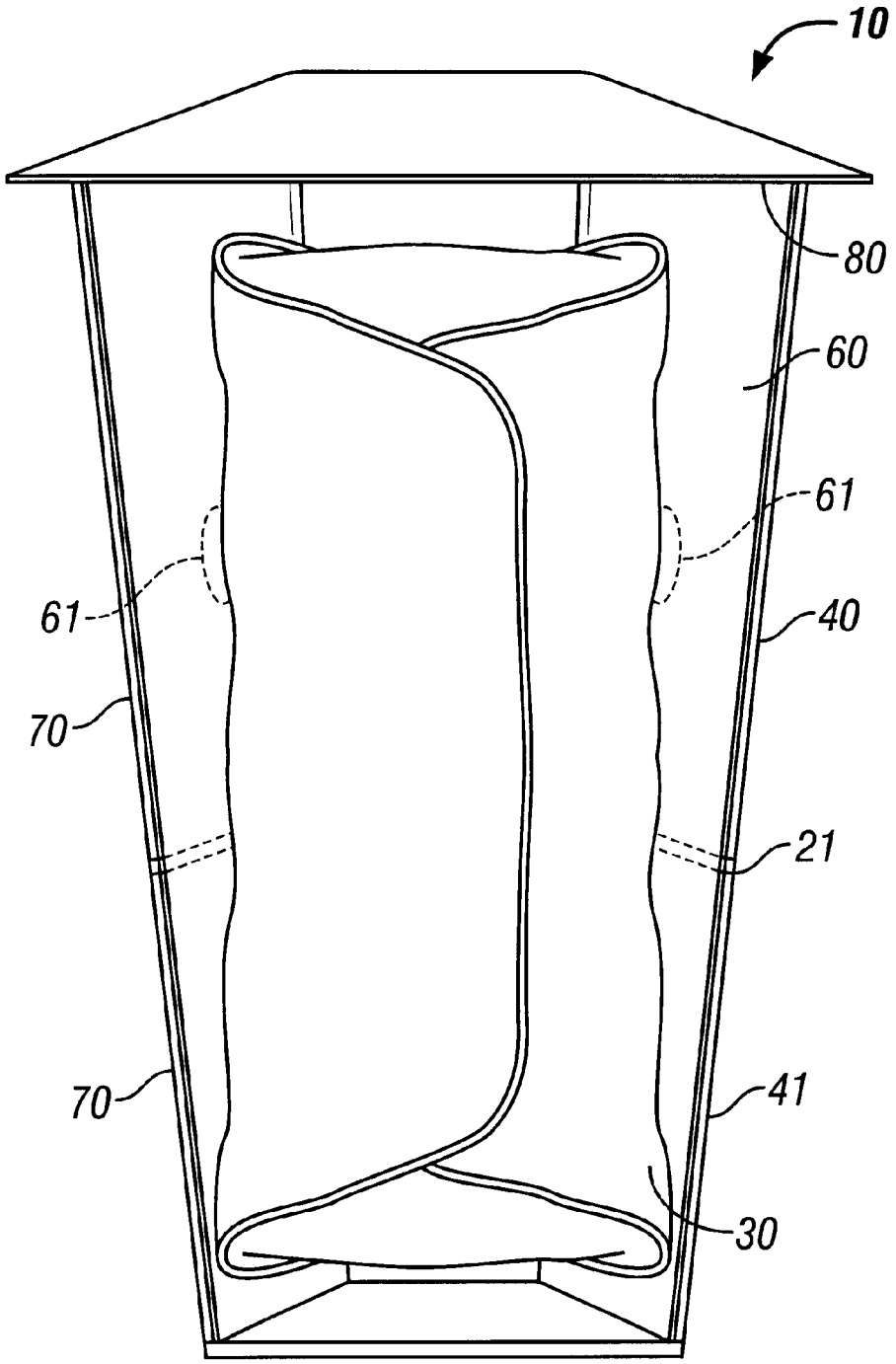
FIG. 6A and FIG. 6B illustrate a cross-sectional of the container.
Figure 6B:
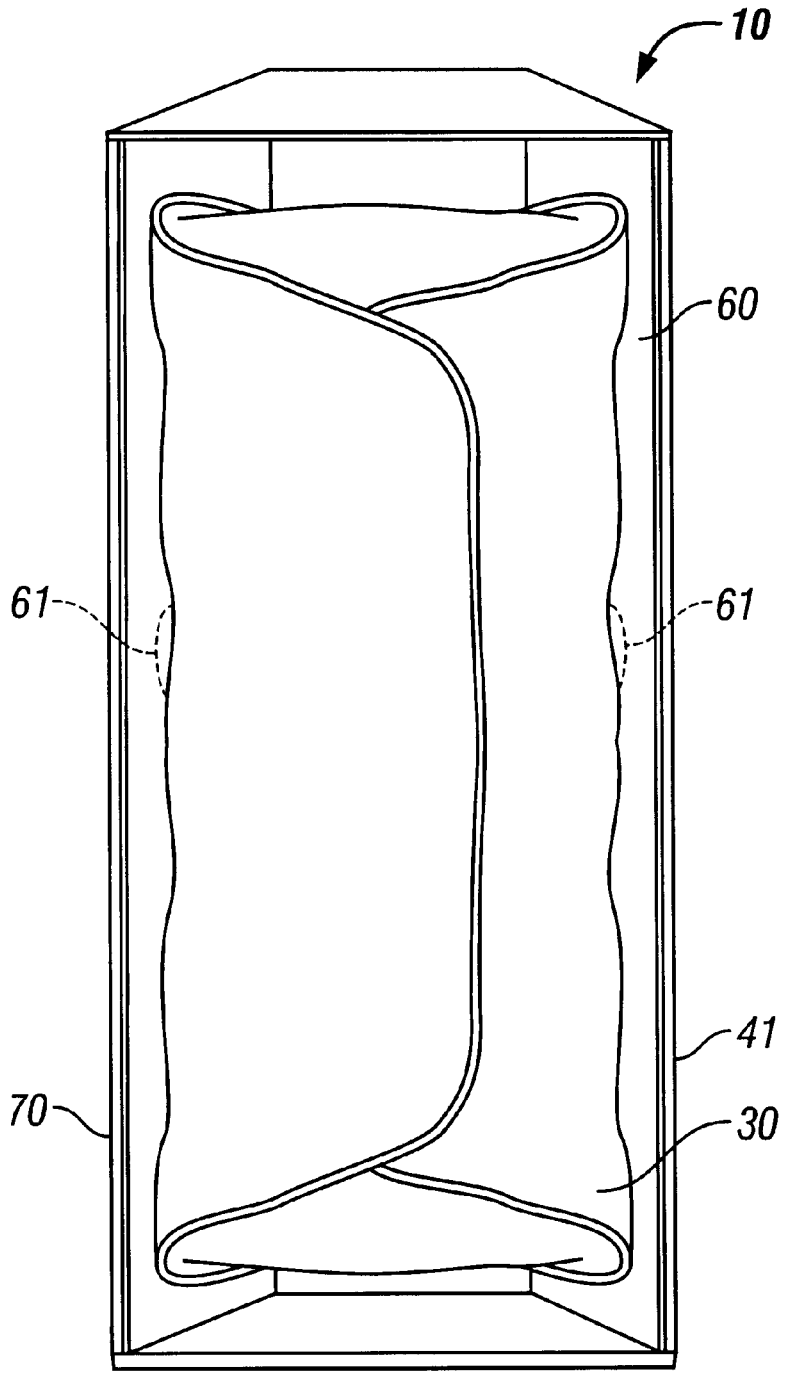

Referring to FIG. 6A and FIG. 6B, the present invention is contemplated to be a microwaveable container. It is known in the art that microwaveable containers contain a designed formed weakness in a seal of the container that can rupture and vent the container when hot gases within the container cause the interior pressure and/or to exceed a desired pressure or temperature 80. As is well known to those skilled in the art, that as the pressure inside the sealed container 10 rises, the temperatures of vapors inside the sealed container 10 also rises. Typically, a number of vents 61 are positioned on the susceptor which rupture and vent the container during heating. Microwaveable containers also contain a microwave susceptor surface 60 positioned as an inner surface of the container. The susceptor surface is a substrate having a microwave-absorptive coating region that is typically adjacent to the item. In the present invention, a thermal insulating surface, positioned outside of the susceptor surface, is added to a portion or all of the microwaveable container.

The susceptor 60 of the present invention is formed from a substrate upon which a coating for absorption of microwave radiation is deposited, printed, extruded, sputtered, evaporated, or laminated. The susceptor 60 may include a pattern that is specific for a particular food item in order to heat the food item evenly. Various patterns include, but are not limited to square matrix, shower flower, hexagonal, slot matrix and or concentric circles. It is also envisioned that the substrate may include a second coating for reflection of a portion of the microwave radiation to which the susceptor is exposed. See U.S. Pat. Nos. 6,251,451, 6,114,679, 5,698,127, 5,038,009, 6,133,560, and 6,150,646, which are incorporated herein by reference. By varying the reflectivity of coating, a membrane is created which is selectively permeable to microwave energy-i.e., it has the ability to control the amount of microwave energy reaching the absorbing coating. It is also envisioned that the substrate may comprise a third coating for shielding. Any method for applying microwave absorbing and reflecting coatings can be used, provided the method does not damage the substrate upon which the coatings are being deposited during the deposition process. See U.S. Pat. Nos. 5,254,821, and 5,038,009, which are incorporated herein by reference. Thus, as used herein, the term susceptor 60 refers to a substrate having a microwave-absorptive layer, a shielding layer, a reflective layer, or any combination thereof to produce the desired heating requirements for any given food item. One such combination includes a single coating having a microwave-absorptive ability, reflective abilities and shielding abilities. Yet further, the susceptor is variable in design depending upon the container type or shape.

The substrate preferably comprises an electrical insulator, e.g., a polymeric film. Materials considered to be useful as the substrate include, for example, but are not limited to polyolefins, polyesters, polyamides, polyimides, polysulfones, polyether ketones, cellophanes, and various blends of such materials. Other non-conducting substrate materials such as paper and paper laminates, silicates, and cellulosics can be used as well.

A variety of electrically conductive materials can be used for the absorbing coating, for example, a single metal, a metal alloy, a metal oxide, a mixture of metal oxides, a dispersion of conductive metallic or non-metallic materials in a binder, or any combination of the foregoing. Suitable exemplary metals include aluminum, iron, tin, tungsten, nickel, stainless steel, titanium, magnesium, copper and chromium. Suitable exemplary metal oxides include oxides of aluminum, iron, and tin, however, if not electrically conductive, they must be used in combination with an electrically conductive material.

Generally, the conductive materials are suspended or dispersed into a vehicle to allow for ease of coating the substrate. Suitable exemplary dispersion materials include carbon black, graphite, powdered metals, and metal whiskers. In a preferred embodiment, the absorbing coating is suspended in an appropriate vehicle having the viscosity necessary for proper transfer in a press inking system. This combination is also referred to as susceptor ink.

It is also contemplated that the susceptor include a selectively permeable reflecting coating or laminate. Examples of such coatings or laminates include, but are not limited to metals or metallic alloys, oxides or mixtures thereof either alone, or as a dispersion in a binder.

The microwave shielding layer attenuates microwave energy to spread microwave transmission more evenly within the container 10, and minimizes contact of microwave energy with the item 30. Suitable metallized microwave shielding materials are disclosed in U.S. Pat. No. 5,300,746, which is incorporated herein by reference.

The present invention also includes a thermal insulating material to protect the item and/or to protect the consumer from the hot item. The thermal insulating material is positioned outside the susceptor 60 and may cover the entire container or only a portion of the container. Thus, the container can be fully insulated to protect the item, such as food, from thawing pre-maturely or warming pre-maturely. Alternatively, the container can be partially insulated, for example as shown in FIGS. 5A, 5B, in which the portion of the container held by the consumer is insulated to protect the consumer from being burned when holding the container.

Suitable materials for the thermal insulation preferably include materials that are capable of being stored and handled at temperatures typical for frozen and/or chilled foods that can also be heated in the package or container and materials that can be stored and microwaved. One such material that may be used is a thermoplastic synthetic resin. See U.S. Pat. No. 4,435,344, which is incorporated by reference. Other materials include for example, cardboard, pulp paper, pressed paper, corrugated or fluted paper or board such as micro fluted board with E, F, B, or C shaped flutes, or single or double faced fluting in which the flutes are facing either in or out. Also included is embossed paper, polystyrene foam, polypropylene foam, polyethylene terephthalate foam, or other similar types of plastic foam. The thermal insulating surface 70 can be adhered to the container 10 using adhesives well known to those skilled in the art of packaging.

Figure 12A:
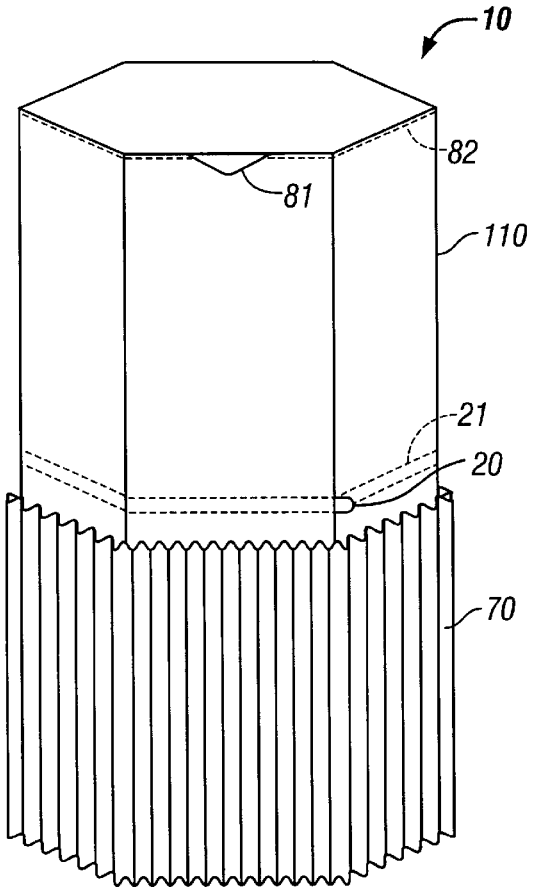
FIG. 12A and FIG. 12B illustrates an alternative embodiment of the container having a thermal insulating surface.
Figure 12B:
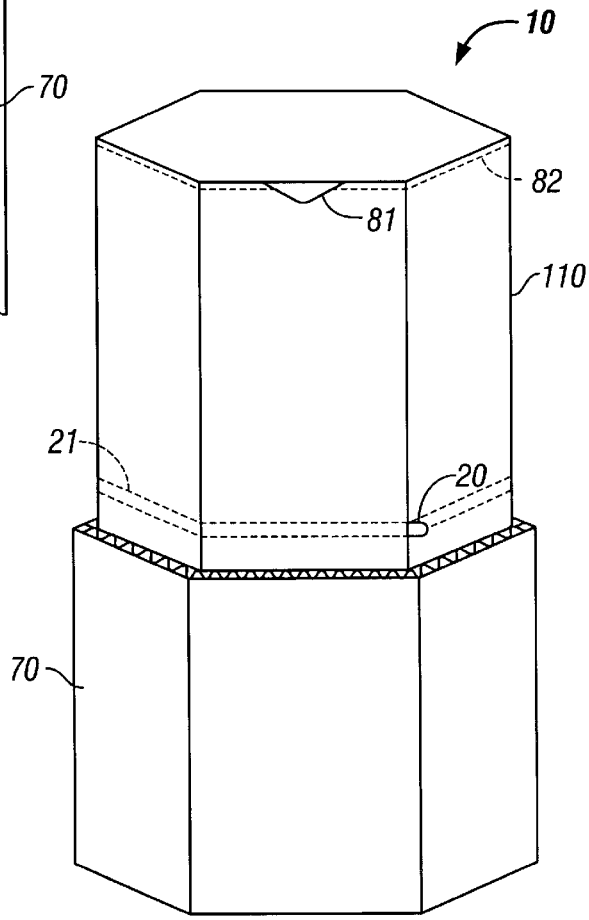

The thermal insulating surface can be positioned in a variety of places within or outside the container 10. For example, the thermal insulating surface 70 can be positioned on the outside of the container 10 (FIGS. 12A and 12B). The outside of the container can be coated or laminated with a thermoplastic synthetic resin film or any other known thermal insulating material such as fluted board can be attached to the surface of container 10. It is envisioned that the thermal insulating layer may cover the entire outside of the container or only a portion of the container, for example, such as part 41, in order to provide a non-heated area of the container 10 for holding by a consumer. The thermal insulating material 70 can surround the entire bottom half of the container or only a portion of the container 10. FIG. 12A illustrates a thermal insulating surface 70 formed from a fluted board. FIG. 12B illustrates a thermal insulating surface 70 formed from a fluted board placed between an inner and outer layer of cellulose material. Another embodiment comprises the thermal insulating surface 70 positioned appropriately for the placement of the consumer's thumb or fingers creating specific insulated pads or areas. Alternatively, a fold-out handle or wings formed of the thermal insulating material can be attached to the outside surface of the container. All of the described embodiments can include areas or pads of thermal insulation or a layer of thermal insulation on all or portions of the surface of the container 10.

The addition of the thermal insulating layer to the hand held container is an important feature of the inventive container. As discussed above, microwaved packages and its contents can reach temperatures up to 400° F. during microwave heating. The addition of the thermal insulating layer allows for a microwaved container to have a comfortable temperature for holding a container of microwaved heated items in a user's hand while using the item. This is because the thermal insulating layer provides a lower rate of heat transfer from the heated item to the outer surface of the container 10, which prevents the outer surface of the container from reaching the temperature of the item contained within the container. Thus, the thermal insulating layer of the inventive container provides a cooler surface so that a user can hold the hand held microwave container immediately upon removal from a microwave oven.

Figure 7A:
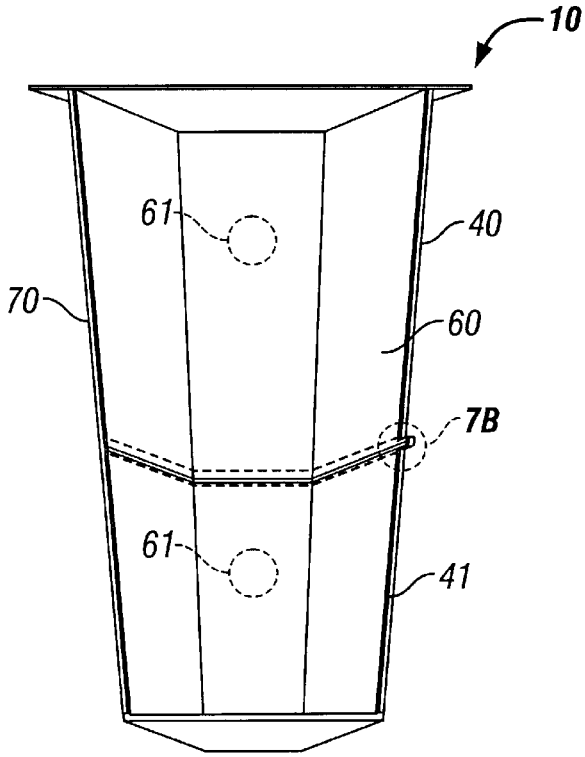
FIG. 7A and FIG. 7B illustrate a cross-sectional of the container and a detail of the tear-strip.
Figure 7B:
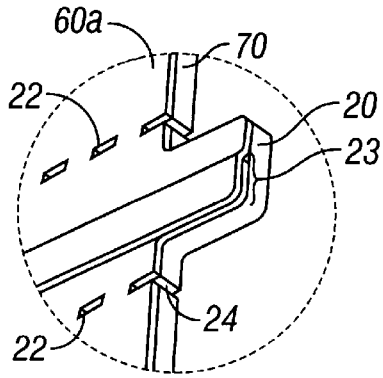
Figure 8A:
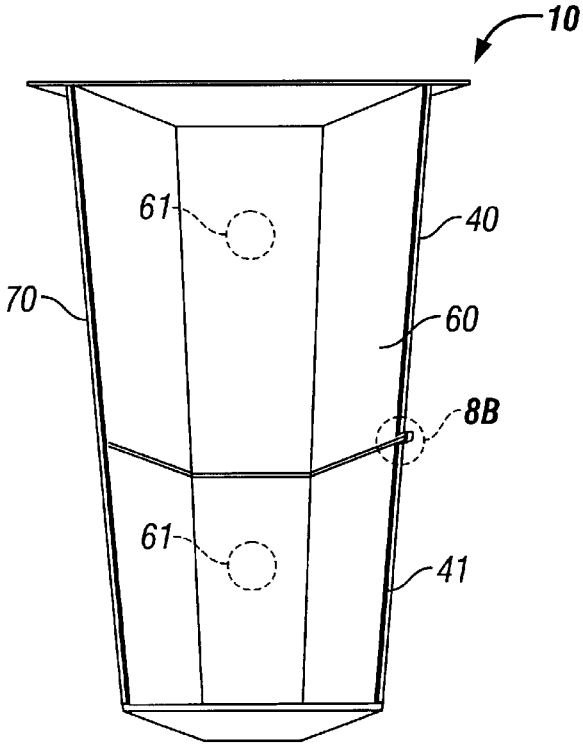
FIG. 8A and FIG. 8B illustrate a cross-sectional of the container and a detail of an alternate embodiment of a tear-strip.
Figure 8B:
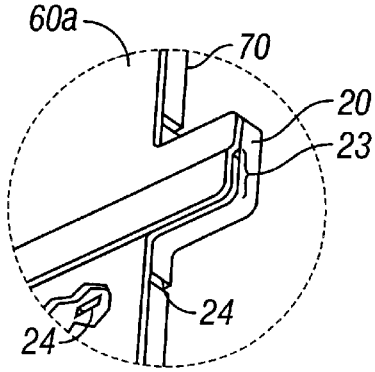

FIG. 7 and FIG. 8 illustrate alternate embodiments of the tear-strip 21 of the present invention. FIG. 7B and FIG. 8B show the tear-strip 21 having a double layer of substrate material 23 positioned along the desired tear-line on the inner surface 60*a* of the substrate 60. The double layer of substrate material 23 provides additional support to the tear-strip 21. Support of the tear-strip 21 ensures that the tear-strip does not break prematurely before the container is opened. Thus, it is apparent that a thin substrate material may require a double layer of substrate to increase support of the tear-strip. However, a thick substrate material may not require a double layer of substrate for support of the tear-strip. The tear-strip 21 is connected to the gripping tab 20 on the outside of the containing for releasing the tear-strip.

FIG. 7B shows a specific embodiment of the tear-strip 21 having stenciled markings 22 on the inner surface 60*a* of the substrate 60. The stenciled markings are perforation markings, which increase the ease of separating the container. In a preferred embodiment, the outside of the container can also contain a perforation marking 24.

In an alternative embodiment, as shown in FIG. 8B, the tear-strip 21 only has perforations 24 on the outer surface of the container. Thus, the substrate 60, which is not perforated, tears or rips when the tear-strip 21 is pulled to separate the container.

Figure 9A:
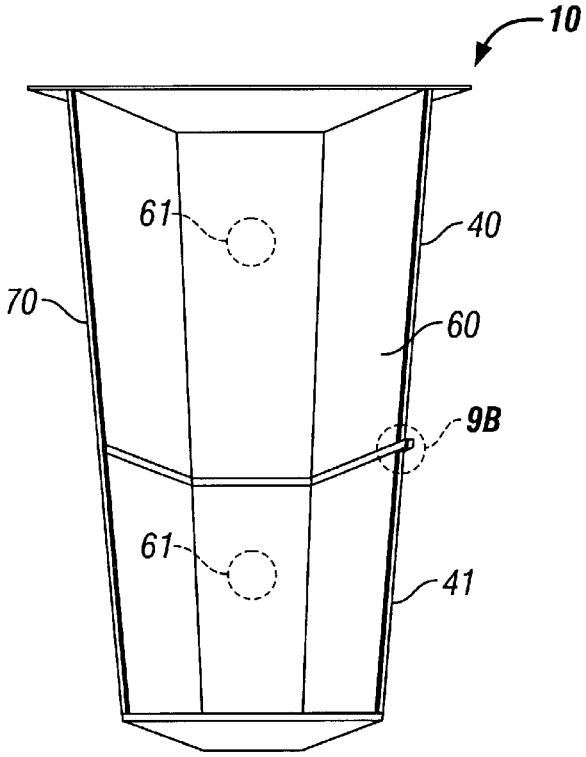
FIG. 9A and FIG. 9B illustrate a cross-sectional of the container and a detail of an alternate further embodiment of a tear-strip.
Figure 9B:
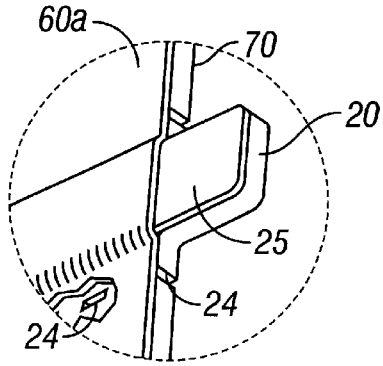

Another alternative is shown in FIG. 9A and FIG. 9B. In this embodiment, the substrate on the inner surface 60*a* of the container includes a thread or strip 25 disposed or embedded within the substrate, which is also connected to a gripping tab 20 on the outside of the container. In a preferred embodiment, the outside of the container also contains a perforation marking 24.

In alternative embodiments, the container 10 may comprise more than one component. For example, the container 10 may include an outer component 110 and an inner component 120. The inner component 120 and the outer component 110 may be constructed using semi-rigid materials, for example, paperboard, corrugated board (micro-flute, E, F or B shaped flute or any other fluted board), paperboard canister, plastic sheet, preferably polyethylene terephthalate (PET). The paperboard could be laminated with a number of films such as susceptor film, PET, or polypropylene. The paperboard could also be coated or laminated to prevent moisture absorption. Any form of polyester would also be suitable as a semi-rigid. It is envisioned that the inner component 120 is inserted into the outer component 110.

Figure 10A:
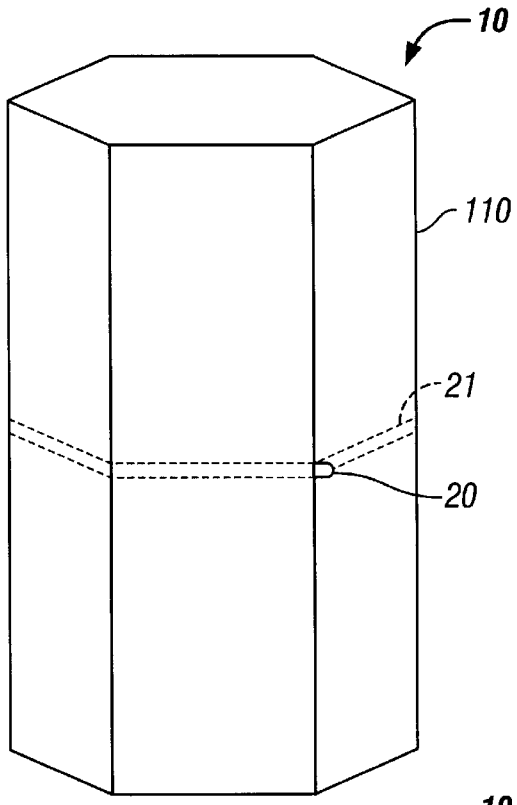
FIG. 10A, FIG. 10B and FIG. 10C illustrate an alternative embodiment of the container having two components, which the inner component is a sleeve (FIG. 10C).
Figure 10B:
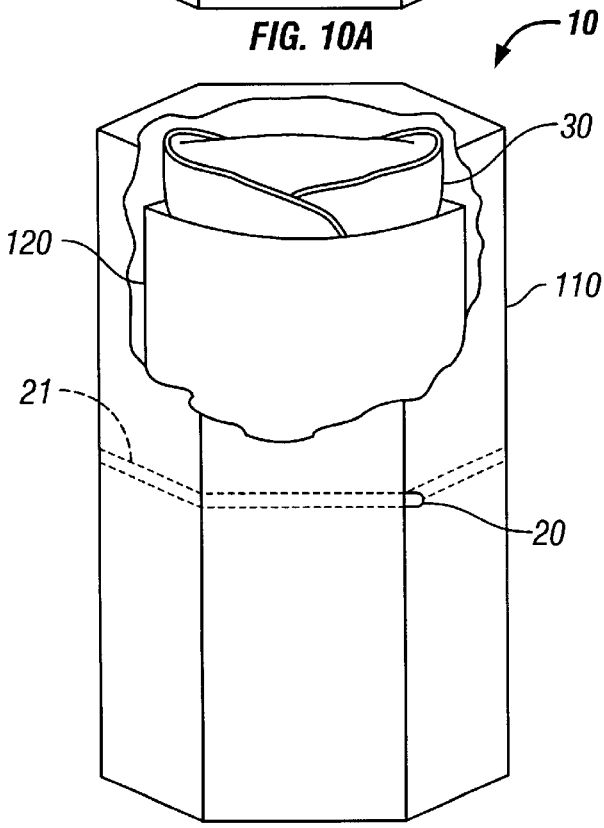
Figure 10C:
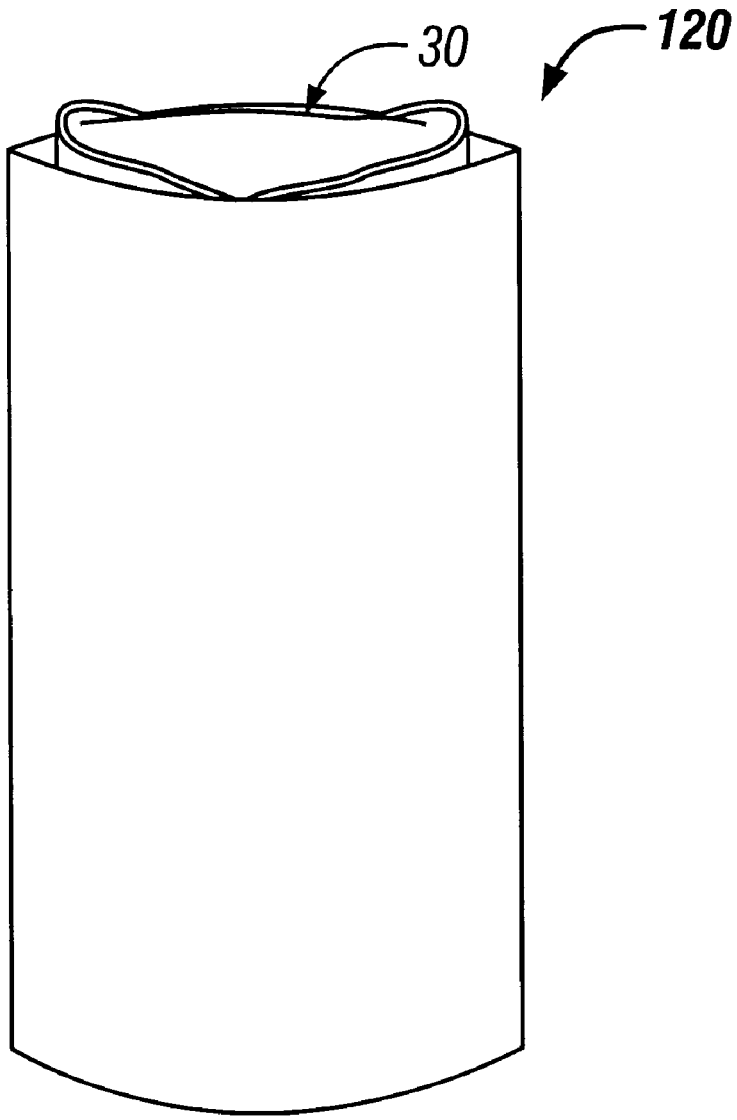

Referring to FIG. 10A, FIG. 10B and FIG. 10C, the container 10 contains two components, an inner component 120 and an outer component 110. The outer component 110 is a closed container having at least two sides, a top and a bottom and is constructed of semi-rigid material. The inner component 120 is also constructed of semi-rigid material and contains at least two sides. The inner component 120 may have either a top or a bottom. Yet further, it is envisioned that the inner component 120 may be a sleeve so that the top and bottom are open, to allow gases to escape the inner component.

Inserting the inner component 120 into the outer component 110, creates a double cell. The double cell creates a space or gas cell between the inner and the outer components. To stabilize the placement of the inner component, the inner component can be connected to the outer component using various mechanisms, for example, adhesives, tabs, etc. Alternatively, a connecting mechanism can be a single die cut that can be folded to result in a container having an inner and outer component.

Figure 11B:
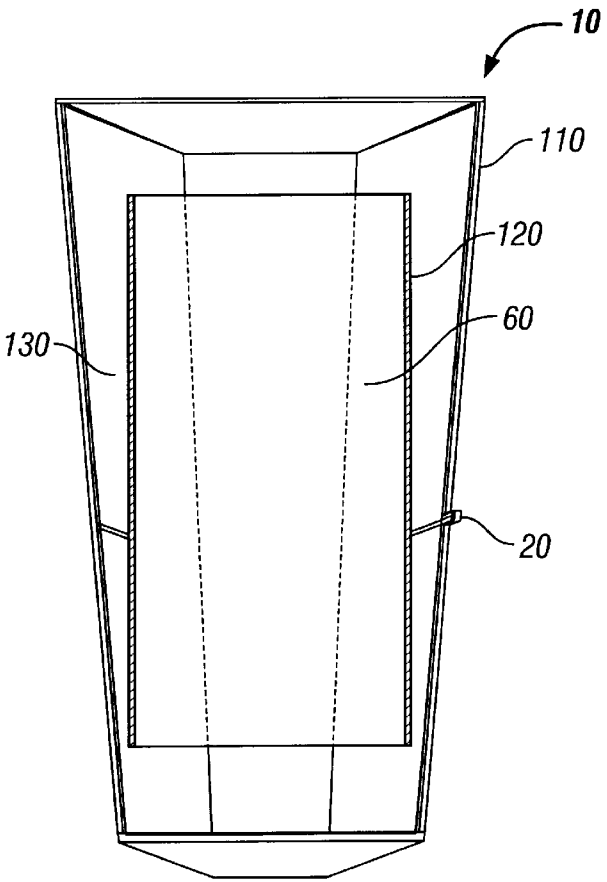
FIG. 11A and FIG. 11B illustrate a cross-sectional of the container having two components, in which the inner component is a sleeve.
Figure 11A:
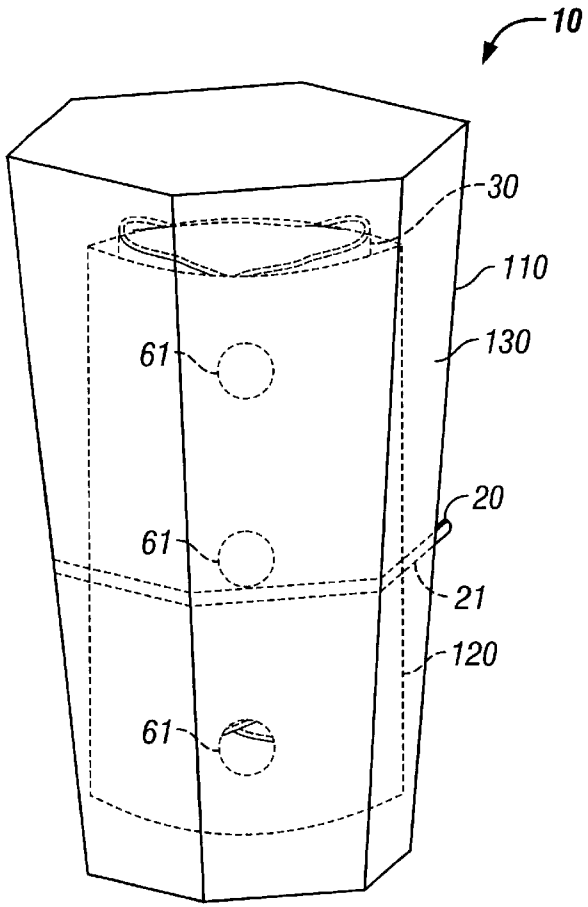

Referring to FIG. 11A and FIG. 11B, microwaveable containers contain a microwave susceptor surface. In this embodiment, the susceptor surface 60 is positioned as an inner surface of the inner component 120 of the container. The susceptor surface is a substrate having a microwave-absorptive coating region that is typically adjacent to the item. The discussion of susceptors, reflective coatings/layers and shielding coatings/layers employed herein is incorporated into this section by reference. Particularly, preferred embodiments, include a susceptor that is formed by depositing, printing, extruding, sputtering, evaporating, or laminating a semi-rigid substrate with a coating for absorption of microwave radiation. Further, the substrate may also contain additional coatings, for example, a shielding layer and/or a reflective layer to prevent excessive heating of the item or any part of the item.

It is also envisioned that the container 10 may include insulating features. For example, FIG. 11A and FIG. 11B illustrate a cross section of the double cell container. The double cell container includes an outer component 110 and an inner component 120. The positioning of the inner component 120 inside the outer component 110 creates a space or gas cell 130 between the two components. One of skill in the art is aware that gas is a natural insulator. The gas in the gas cell is preferably atmospheric air. In addition to atmospheric air, the gas cell may also include bubble wrap, foam or any other expanded material that contains air spaces. The gas cell provides an additional layer of separation or a thermal insulating layer between the hot susceptor material and the outer component 110, which is handled by the consumer. Thus, the gas cell also provides a means to allow air circulation inside the container which decreases the rate of heat transfer to the outer component 110 or outer surface of the container resulting in an outer surface of the container that can be handled using one hand immediately after heating.

A further embodiment is a container having at least two layers of separation from the susceptor material to the consumer's hand. The first layer is a gas cell, and the second layer is the outer component 110. Additional layers of separation may also be added, for example, but not limited to a thermal insulating surface 70 may be added to the outer component 110 as shown in FIG. 12, which all thermal insulating embodiments discussed previously are incorporated herein by reference. It is also envisioned that the container or the outer component itself may be formed using a thermal insulating material in which the insulating material provides structure to the container.

Figure 13A:
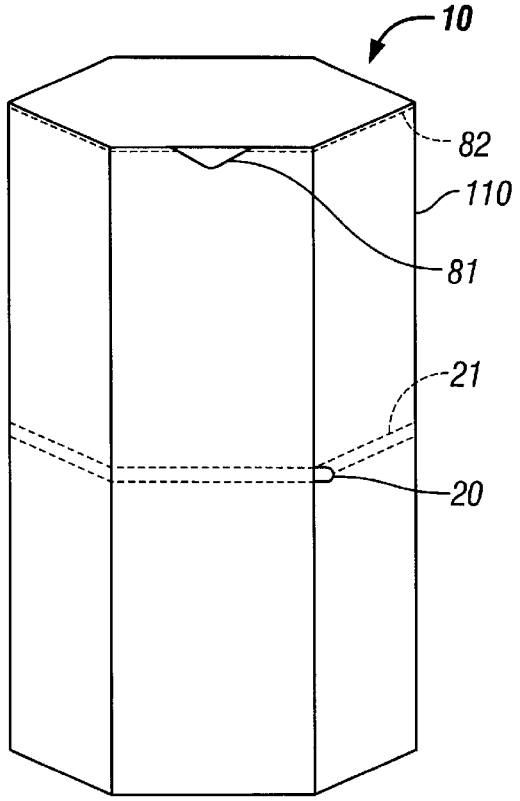
FIG. 13A and FIG. 13B illustrate an embodiment of the container having an alternative venting mechanism.
Figure 13B:
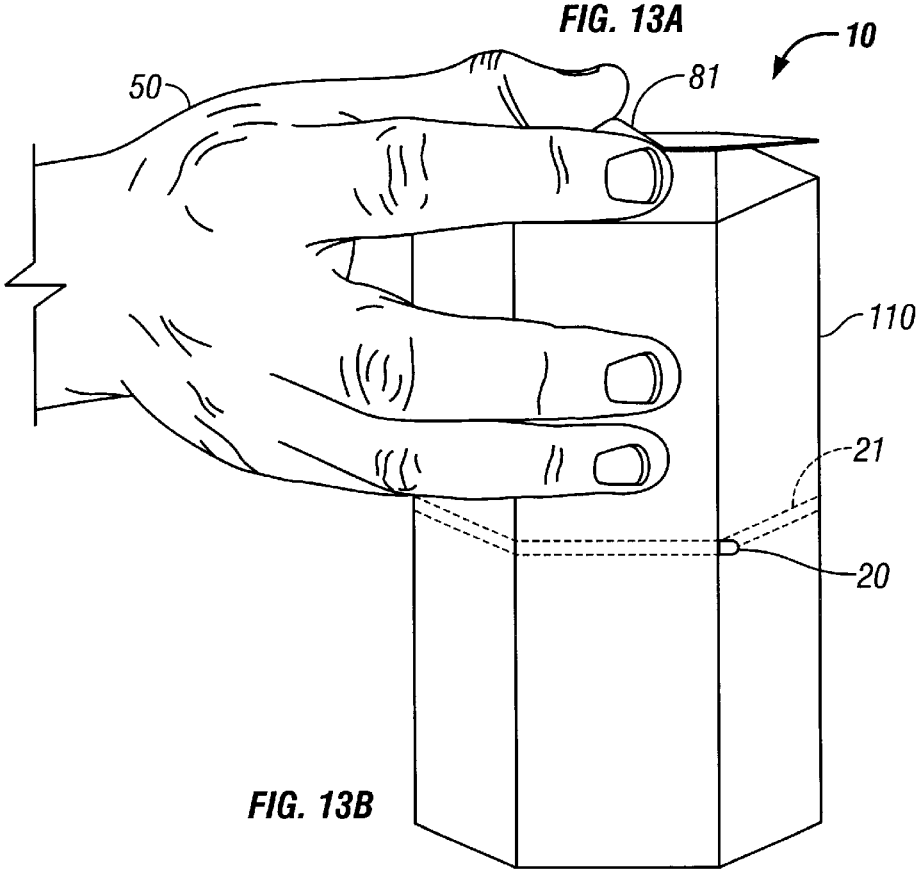

Yet further, it is known in the art that microwaveable containers contain venting mechanisms to release hot gases within the container when the interior pressure and/or temperature exceeds a desired pressure or temperature. FIG. 13A and FIG. 13B illustrate an alternative venting mechanism of the container 10. The container 10 contains a perforated thumb or finger notch 81. The notch 81 is connected to a tear-line 82, which is positioned along the top of the container 10. The tear-line 82 may be a perforated line that surrounds the entire top of the container 10 or is partially around the top of the container 10. Prior to inserting the container into the microwave, the consumer punches the notch 81 and lifts upward to open the top along the perforated tear-line 82 (FIG. 13B). It is envisioned that the combination of the notch 81 and the perforated tear-line 82 provide a venting mechanism for the container 10. It is known by those of skill in the art that a venting mechanism prevents the microwaveable container from rupturing due to increases in pressure. Another advantage of a vent is to prevent an increase in excess moisture due to condensation from the build up of gases. Increase moisture may be beneficial for food items that contain a high water content, i.e., soups, however, moisture may not be beneficial for food items, i.e., dough items. Thus, a vent releases the gases and prevents an increase in excess moisture.

In further embodiments, the container 10 may contain a weakness in a seal of the container that ruptures and vents the container when hot gases within the container cause the interior pressure and/or to exceed a desired pressure or temperature.

It is also envisioned that the present microwaveable container may be vented by mechanically creating at least one hole or opening in the container. Alternatively, multiple holes, i.e., two or more, may be used to created a chimney effect. The chimney effect allows the air to circulate through the container during the cooking process. It is possible to achieve the chimney effect by having an opening at the top and an opening at the bottom of the container. These openings can be made by the consumer using finger or thumb notches as shown in FIG. 13A and FIG. 13B.

FIG. 11A illustrates a specific embodiment of the inner component 120 containing vents 61 to release steam into the gas cell. The vents 61 are die cut holes in the inner component. These die cut holes allow the passage of microwave energy into the item. Also, the die cut holes allow steam from the inner component to be released into the gas cell 130. Once the steam is in the gas cell, the gas cell is vented to the atmosphere via a vent 80.

Alternatively, steam may be directed out of the inner component by placing focus holes on the susceptor of the inner component 120. Focus holes are sections of the susceptor that have been demetallizing. Demetallized sections or focus holes allows the passage of microwave energy into the item without allowing steam to leave the inner component 120. Thus, steam in the inner component is vented to the atmosphere via a vent 80.

Easy open mechanisms are also contemplated for the outer and inner components 110, 120. For example, an inner or outer component semi-rigid material can include easy open mechanisms such as a perforated, thread or strip embedded tear strip, a tear notch, oriented film, a laser etch line or a mechanical etch such as perforations, tear tape or tear glue or the inner component 120 can include a center split opening in order to allow access to the item. In a specific embodiment, a spiral tear strip can be used in the outer component 110. The tearing action results in a downward spiral opening of the outer component. A spiral tear-strip would provide the consumer easy access to the bottom of the item without the consumer having to handle the hot item. The manufacturing of these easy open mechanisms are known to one skilled in the art of packaging.

Figure 14A:
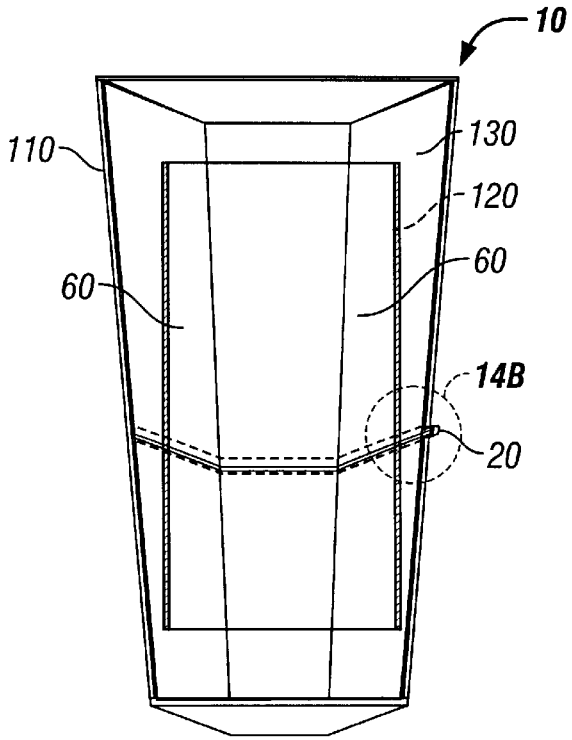
FIG. 14A and FIG. 14B illustrate a cross-sectional of the container having two components and a detail of the tear-strip.
Figure 14B:
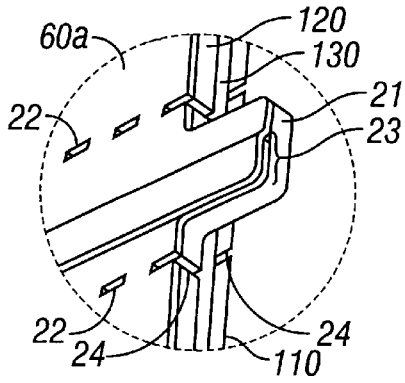
Figure 15A:
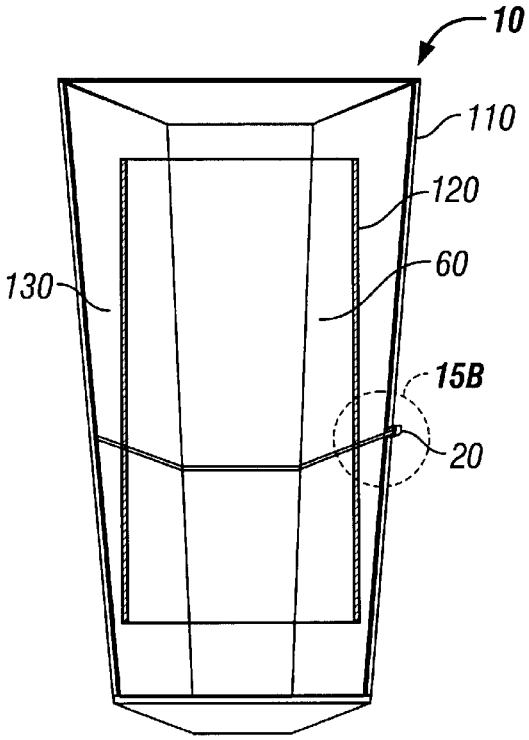
FIG. 15A and FIG. 15B illustrate a cross-sectional of the container having two components and a detail of an alternate embodiment of a tear-strip.
Figure 15B:
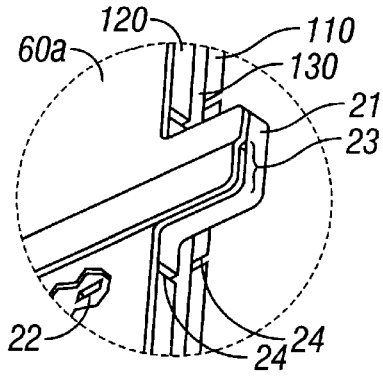

FIG. 14 and FIG. 15 illustrate specific embodiments of the tear-strip 21 of the double cell container. FIG. 14B and FIG. 15B show the tear-strip 21 having a double layer of substrate material 23 positioned along the desired tear-line on the inner surface 60*a* of the substrate 60, which is located on the inner surface of the inner component 120. The double layer of substrate material 23 provides additional support to the tear-strip 21. Support of the tear-strip 21 ensures that the tear-strip does not break prematurely before the container is opened. Thus, it is apparent that a thin substrate material may require a double layer of substrate to increase support of the tear-strip. However, a thick substrate material may not require a double layer of substrate for support of the tear-strip. The tear-strip 21 is connected to the gripping tab 20 on the outside of the outer component 110 of the container for releasing the tear-strip.

FIG. 14B shows a specific embodiment of the tear-strip 21 having stenciled markings 22 on the inner surface 60*a* of the substrate 60. The stenciled markings are perforation markings, which increase the ease of separating the container. In a preferred embodiment, the outside of the inner component 120 and the outer component 110 can also contain a perforation marking 24. The tear-strip 21 is connected between the inner and the outer component. Thus, grabbing tap 20 and pulling initiates the tearing mechanism and the tear-strip 21 is positioned such that it separates the two components simultaneously.

In an alternative embodiment, as shown in FIG. 15B, the tear-strip 21 only has perforations 24 on the outer surface of both the inner component 120 and the outer component 110. Thus, the substrate 60, which is not perforated, tears or rips when the tear-strip 21 is pulled to separate the container.

Figure 16A:
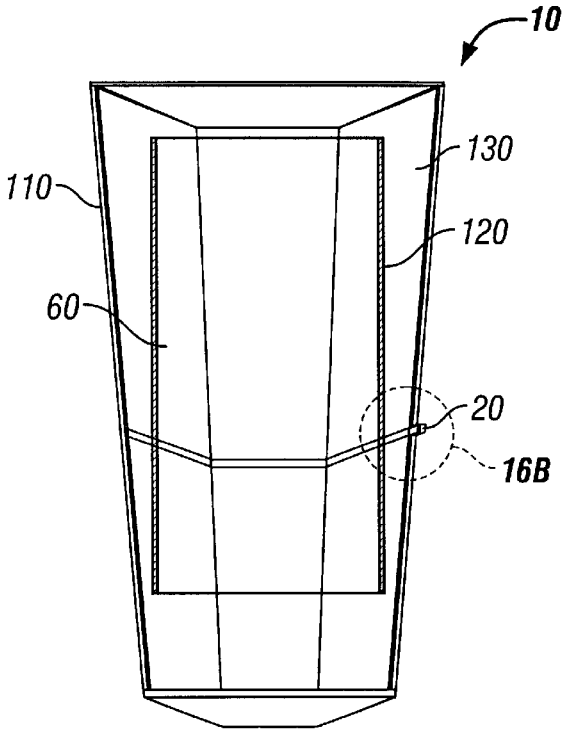
FIG. 16A and FIG. 16B illustrate a cross-sectional of the container having two components and a detail of an alternate further embodiment of a tear-strip.
Figure 16B:
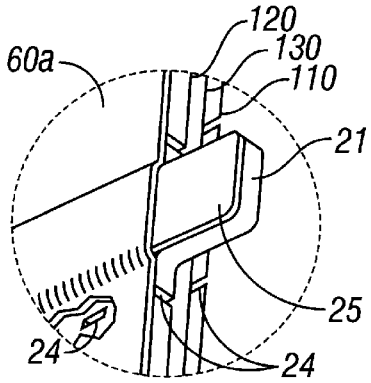

Another alternative is shown in FIG. 16A and FIG. 16B. In this embodiment, the substrate on the inner surface 60*a* of the inner component 120 includes a thread or strip 25 disposed or embedded within the substrate, which is also connected to a gripping tab 20 on the outside of the outer component 110. In a preferred embodiment, the outside of the inner component 120 and outer component 110 also contains a perforation marking 24.

Figure 17:
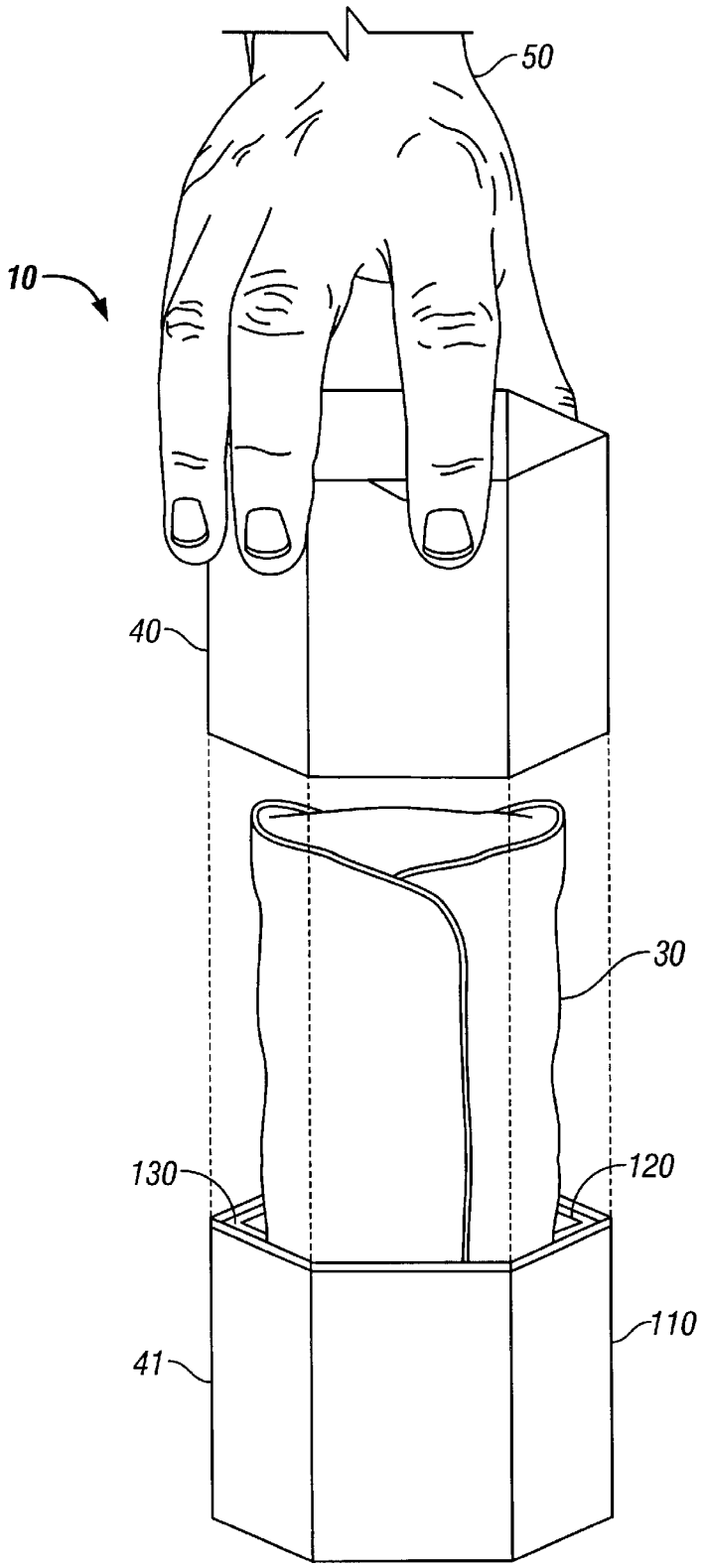
FIG. 17 illustrates the container having two components in an open position in which the container is separated into parts.

FIG. 17 illustrates the container 10 having two components 110 and 120 being separated into two parts 40, 41 to allow easy access to the food item 30. The separation of the container 10 occurs via a tear-strip 21 of which is positioned horizontally on the container.

The hand held container of the present invention also includes features such as a moisture barrier to prevent the container 10 from becoming soggy and leak-proof seals and/or leak-proof ends to prevent the item 30 from leaking out of either the inner or outer components 110, 120.

In another embodiment of the present invention, the container may further include graphics on the outside or inside of the container. It is envisioned that the graphics are printed on the outside or inside of the container using thermotropic ink or resin to display or provide instructions for handling the food item. Thermotropic inks change color at elevated temperatures or temperature changes. Any thermotropic ink and method for applying thermotropic ink can be used in the present invention, provided that the ink used is capable of being stored and handled at temperatures typical for frozen and/or chilled items, such as foods. See U.S. Pat. No. 4,155,895, which is incorporated herein by reference. The present invention can also include thermotropic ink as a temperature indicator or any other temperature indicating device that can be used to alert a consumer that the item has been heated or is too hot to handle or use.

It is also envisioned that the present invention can be utilized for any purpose in which hand held packaging suitable for microwaving is desired. For example the microwaveable container can be used for craft materials in which a craft material needs to be heated, such as wax. In the field of cosmetics, the hand held package could be utilized to contain facial or body wrap products that requiring heating. In the medical field, the hand held package could be utilized for medication, wraps or casting materials that require heating.

Although the present invention and its advantages have been described in detail, it should be understood that various changes, substitutions, and alterations can be made herein without departing from the spirit and scope of the invention as defined by the appended claims. As one of ordinary skill in the art will readily appreciate from the disclosure of the present invention, processes, manufacture, compositions of matter, means, methods, or steps presently existing or later to be developed that perform substantially the same function or achieve substantially the same result as the corresponding embodiments described herein may be utilized according to the present invention. Accordingly, the appended claims are intended to include within the scope of such processes, manufacture, compositions of matter, means, methods, or steps.

What is claimed is:

1. A container for heating an item using microwaves comprising:

a container for microwave heating, wherein the container comprises a semi-rigid outer component and a semi-rigid inner component;

a microwave susceptor surface positioned as an inner surface of said inner component, comprising a substrate having a microwave-absorptive coating region; and a thermal insulating layer positioned as an outer surface of said inner or outer component which protects the consumer from being burned from the hot item after heating in a microwave oven.

2. The container of claim 1 further comprising a tear-strip easy open device, wherein the tear-strip allows for easy and convenient access to an item after heating in a microwave oven.

3. The container of claim 1, wherein the item is a food item.

4. The container of claim 3, wherein said thermal insulating layer protects said food item from warming prematurely.

5. The container of claim 1, wherein said microwave-absorptive region is deposited, printed, extruded, or laminated on said substrate.

6. The container of claim 1, further comprising graphics on the outside of said container, wherein said graphics are printed with thermotropic ink.

7. The container of claim 6, wherein said graphics provide instructions for handling said item.

8. A container for heating an item using microwaves comprising:

a container for microwave heating, wherein the container comprises a semi-rigid outer component and a semi-rigid inner component;

a microwave susceptor surface positioned as an inner surface of said inner component, comprising a substrate having a microwave-absorptive coating region;

a thermal insulating layer positioned as an outer surface of said inner or outer component which protects the consumer from being burned from the hot item after heating in a microwave oven; and a tear-strip easy open device, wherein the tear-strip allows for easy and convenient access to the hot item after heating in a microwave oven.

9. The container of claim 8, wherein said microwave-absorptive region is deposited, printed, extruded, or laminated on said substrate.

10. The container of claim 8, further comprising graphics on the outside of said container, wherein said graphics are printed with thermotropic ink.

11. The container of claim 10, wherein said graphics provide instructions for handling said item.

12. The container of claim 8, wherein said container is a hand-held, portable container which is held in one hand during use of said item.

13. A container for heating an item using microwaves comprising:

a container for microwave heating, wherein the container comprises a semi-rigid outer component and a semi-rigid inner component;

a microwave susceptor surface positioned as an inner surface of said inner component, comprising a substrate having a microwave-absorptive coating region; and a thermal insulating layer positioned as a gas cell between said inner and outer components which provides a means for circulation of gases to decrease the rate of heat transfer from the inner component to the outer component to protect the consumer from being burned from the hot item after heating in a microwave oven.

14. The container of claim 13, wherein the inner component is connected to the outer component to stabilize the placement of the inner component.

15. The container of claim 13, wherein the inner component contains vents to release steam into the gas cell.

16. The container of claim 13, wherein the susceptor contains focus holes to release steam into the gas cell.

* * * * *